United States Patent [19]

Notaro

[11] 4,216,819

[45] Aug. 12, 1980

[54] ENHANCED CONDENSATION HEAT TRANSFER DEVICE AND METHOD

[75] Inventor: Frank Notaro, Amherst, N.Y.

[73] Assignee: Union Carbide Corporation, New York, N.Y.

[21] Appl. No.: 15,426

[22] Filed: Feb. 26, 1979

Related U.S. Application Data

[62] Division of Ser. No. 721,862, Sep. 9, 1976, Pat. No. 4,154,294.

[51] Int. Cl.[2] ..... F28B 9/08

[52] U.S. Cl. ..... 165/1; 165/110; 165/133

[58] Field of Search ..... 165/1, 110, 111, 133; 428/553, 559; 138/38, 146

[56] References Cited

U.S. PATENT DOCUMENTS

| | | | |
|---|---|---|---|
| 3,024,128 | 3/1962 | Dawson | 427/376 R |
| 3,161,478 | 12/1964 | Chessin | 165/133 |
| 3,384,154 | 5/1968 | Milton | 165/133 |
| 3,622,403 | 11/1971 | French | 148/12 R |
| 3,653,942 | 4/1972 | Boebel et al. | 165/133 |
| 3,689,987 | 9/1972 | Teague | 428/553 |
| 3,751,295 | 8/1973 | Blumenthal et al. | 165/133 |
| 3,990,862 | 11/1976 | Dahl et al. | 165/133 |
| 4,018,264 | 4/1977 | Albertson | 165/133 |

OTHER PUBLICATIONS

An Analysis of Film Condensation on Wavy Surfaces, R. Gregorig, Zeitschrift fuer Angewande Mathematik & Physik, vol. 4, pp. 40–49 (1954).

The Effect of Surface Roughness on Condensing Steam, A. A. Nicol et al., Canadian Journal of Chem. Eng., pp. 170, 173 (Jun. 1966).

Heat and Momentum Transfer in Smooth and Rough Tubes, Dipprey et al., Journal of Ind. Heat and Mass Transfer, vol. 6, pp. 329–353 (1963).

Electrodeposition of Porous Metal, Faust et al., Transactions of the Institute of Metal Finishing, vol. 31, pp. 517–526 (1954).

*Primary Examiner*—S. J. Richter

*Attorney, Agent, or Firm*—John C. LeFever

[57] ABSTRACT

A metal substrate is provided with a single layer of randomly distributed metal bodies bonded to the substrate, spaced from each other and substantially surrounded by the substrate to form active condensation heat transfer surface and body void space.

3 Claims, 10 Drawing Figures

FIG. 2
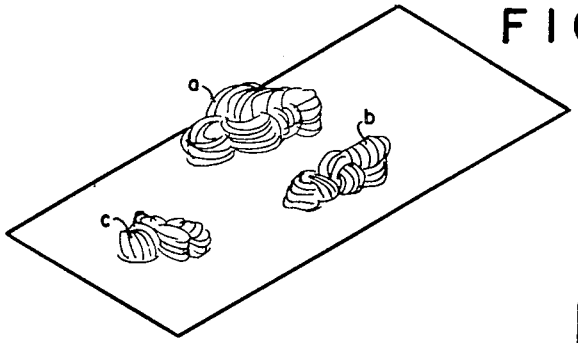
FIG. 3A
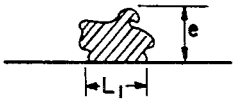
FIG. 3B
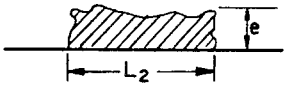
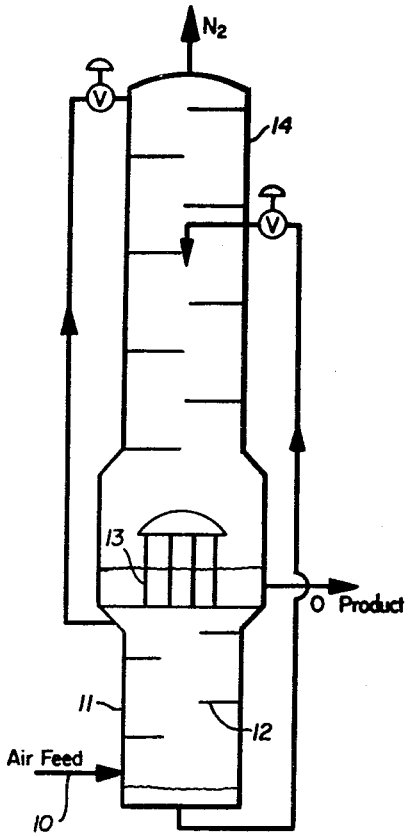
FIG. 5
FIG. 4
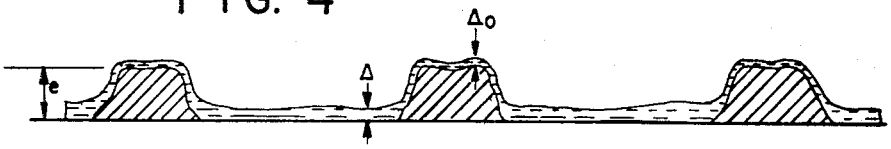

ENHANCED CONDENSATION HEAT TRANSFER DEVICE AND METHOD

This application is a division of our prior U.S. application Ser. No. 721,862, filing date Sept. 9, 1976, now U.S. Pat. No. 4,154,294.

BACKGROUND OF THE INVENTION

This invention relates to an enhanced condensation heat transfer device, a shell-tube type heat exchanger with an enhanced heat transfer surface on the tube outer side, and a method for enhanced condensation heat transfer.

Indirect transfer of heat between fluids involves three resistances. A first resistance is associated with the high temperature heat source, a second resistance is imposed by the medium which separates the fluids, and a third is associated with the low temperature heat sink. For systems which allow the use of a material with high thermal conductivity, the resistance of the separating medium to the transfer of heat is small, therefore, the rate at which heat is transformed generally is controlled by the flow conditions and properities of the fluid mediums. Relative to the low temperature heat sink, coefficients in the order of 1000 BTU/hr, $ft_2$, °F. are achievable in sensible heat transfer. For processes involving a boiling low temperature medium, which practice the technology of Milton U.S. Pat. No. 3,384,154 or Kun et al. U.S. Pat. No. 3,454,081, coefficients of 8,000 to 12,000 BTU/hr, $ft^2$, °F. are achievable. The resistance associated with the high temperature heat source often controls the rate of heat transfer, particularly in processes involving condensation, wherein coefficients of less than 500 BTU/hr, $ft^2$, °F. are commonly encountered. In such systems, the liquid film which forms on the condensing surface represents the major resistance to heat transfer, and is particularly high in shell and tube equipment, wherein condensation occurs external of the tubes and drains from the surface under the influence of gravity.

The prior art teaches a variety of surface configurations which enhance heat transfer rates in processes involving condensation, wherein the condensate drains from the surface under the influence of gravity. Shell side condensation in shell and tube heat exchangers exemplifies such processes.

Gregorig ("An Analysis of Film Condensation on Wavy Surfaces" Zeitschrift fuer Angewande Mathematik and Physik, Vol. 4, pp. 40–49, teaches a method which relies on the pressure gradient associated with variations in liquid surface profile due to surface tension. Its general principles have successfully been applied to design a number of configurations which enhance the rate of condensing heat transfer. Gregorig's work was based on steam condensation and utilized a surface construction of specific dimensions, as indicated by his mathematical derivations, to obtain maximum condensation efficiency. The Gregorig surface is for application on the outer condensing surface of vertically oriented condensation tubes and its configuration can be described as a series of alternatives, rounded crests and valleys which extend axially over the length of the tube. In the vicinity of the crest region, the convexity of the heat transfer surface causes an overpressure of the condensate film's fluid pressure relative to a flat liquid surface. The higher pressure of the condensate results from its surface tension and the convex curvature of the film. In the "valley" region, a lower pressure exists due to the concave surface curvature. A resulting pressure gradient is set up in the direction of crest to valley, so that liquid condensing in the neighborhood of the crests flows readily into the valleys to flow there through under the influence of gravity. The overall effect minimizes the condensate film thickness of the crests with a corresponding increase of the heat transfer coefficient.

The surfaces which have been developed to exploit the teachings of Gregorig involve grooved, finned and channeled configurations, and require appreciable alteration of the primary heat transfer structure and present fabricational and economic drawbacks. Expectedly, the systems reflect concern regarding the ease with which the collected condensate is drained from the system, and are restricted to drainage means which constitute an unimpeded flow path for condensate egress.

A second approach to enhancing condensing heat transfer relates to means of increasing the fluid turbulence in the condensate film. In a study of a surface roughened by cutting left and right-handed threads on the outside surface of a pipe, Nicol and Medwell ("Velocity Profiles and Roughness Effects in in Annular Pipes", Journal Mech. Eng. Science, Vol. 6, No. 2, pp 110–115, 1964) discovered that the friction factor-Reynolds Number relationship resembled that of the sand-roughened pipes studied by Nikuradse ("Strömingegesetze in rauben Rohren", Forech Arb. Ing. Wes. No. 361, 1933). It is known that "mirror" image close packed sand-grain roughened surfaces enhance sensible heat transfer by disrupting the sublayer of the fluid boundary layer, thereby reducing its depth and its resistance to the transfer of heat (Dipprey, P. and Sabersky, R., "Heat and Momentum Transfer in Smooth and Rough Tubes at Various Prandtl Numbers", Int. Journal, Heat and Mass Transfer, Vol. 6, pp 329–353, 1963). Accordingly, in a condensing heat transfer study of the Nicol-Medwell roughened surface ("The Effect of Surface Roughness on Condensing Steam", Canadian Journal of Chem Eng., pp 170, 173, June, 1966), the data was analyzed on the basis of the turbulence promoting effect which sand-grained roughened surfaces are known to exert on the laminar sublayer. Nicol and Medwell measured localized heat transfer coefficients which were 400% of smooth tube performance, however, over the greater extent of the tested 8 ft long tube, values in the order of only 200% of smooth tube performance were obtained. A 200% enhancement represents a marginal improvement relative to the performance reported for Gregorig type surfaces and, therefore, the Nikol-Medwell technology has not excited commercial interest.

An object of this invention is to provide an enhanced heat transfer device having a condensation heat transfer coefficient substantially higher than obtained by the prior art.

Another object is to provide a heat transfer device characterized by high condensation coefficient, which is relatively inexpensive to manufacture on a commercial mass-production basis.

Still another object is to provide an improved shell-tube type heat exchanger characterized by enhanced condensation heat transfer means on the tube outer surface.

A further object of this invention is to provide a method for enhanced condensation heat transfer in a heat exchanger wherein a first fluid is condensed and drained from the one side of a metal wall by heat exchange with a colder second fluid on the other side of said metal wall.

Other objects and advantages of this invention will be apparent from the ensuing disclosure and appended claims.

IN THE DRAWINGS:

FIG. 2 is an enlarged schematic view looking downwardly on a metal sheet substrate with three metal bodies bonded thereto.

FIG. 3A is an enlarged schematic elevation view of a single metal body-substrate showing the metal body minor dimensions $L_1$.

FIG. 3B is an enlarged schematic elevation view of a single metal body-substrate showing the metal body-substrate major dimension $L_2$.

FIG. 4 is an enlarged schematic elevation view of the metal body-substrate showing the condensation-draining mechanism of the invention.

FIG. 5 is a schematic flow diagram of a cryogenic air separation double column-main condenser employing the enhanced heat transfer device of this invention for condensation heat transfer.

SUMMARY

Figure 1:
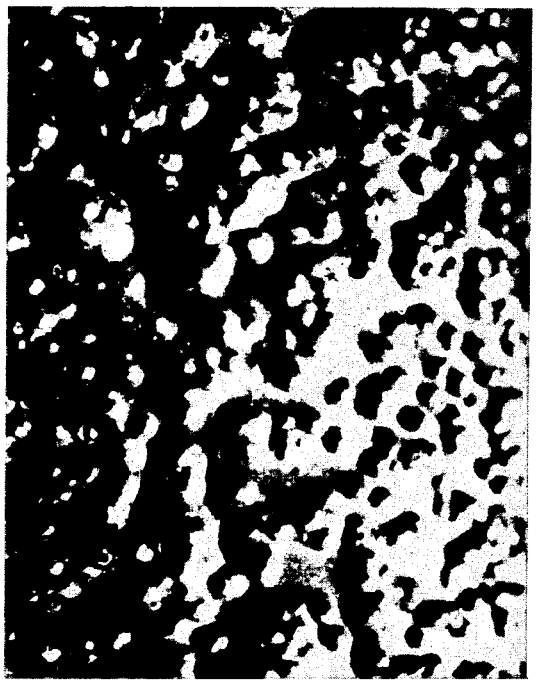
FIG. 1 is a photomicrograph plan view looking downwardly on a single layer of randomly distributed metal bodies each bonded to the outside surface of a tubular substrate, thereby forming an enhanced condensation heat transfer device of this invention (5X magnification).

This invention relates to an enhanced condensation heat transfer device, a shell and tube type heat exchanger with an enhanced heat transfer surface on the tube outer side, and a method for enhancing condensation heat transfer.

In prior art enhanced Nusselt condensation heat transfer devices, the logical direction has been to minimize liquid drainage flow constriction in the flow channels by providing unimpeded straight channels of minimum length, e.g., axial grooves on the outer surface of vertically oriented tubes. I have discovered that the torturous liquid drainage channels characteristic of this invention do not impose a severe restriction to condensate drainage. The condensation heat transfer performance of this invention compares favorably to the performance of the best of the enhancement surfaces described in the prior art and is superior to the performance of many, all of which prior art share the common feature of straight, open, unimpeded drainage channels. Moreover, the present enhanced heat transfer device is substantially less expensive to manufacture on a commercial mass production basis.

In the apparatus aspect of this invention, an enhanced heat transfer device is provided comprising a metal substrate and a single layer of randomly distributed metal bodies each individually bonded to a first side of said substrate spaced from each other and substantially surrounded by the substrate first side so as to form body void space, with the arithmetic average height e of the bodies between 0.005 inch and 0.06 inch and the body void space between 10 percent and 90 percent of substrate total area. For reasons discussed hereinafter, the arithmetic average height e of the bodies is preferably between 0.01 inch and 0.04 inch, and the body void space is preferably between 40 percent and 80 percent of the substrate total area. In another preferred embodiment, a multiple layer of stacked metal particles is integrally bonded together and to the side of the metal substrate which is opposite to said first side, to form interconnected pores of capillary size having an equivalent pore radius less than about 4.5 mils.

In connection with preparation of enhanced heat transfer devices, the metal bodies may for example comprise a mixture of copper as the major component and phosphorous (a brazing alloy ingredient) as a minor component. In another commercially useful embodiment, the metal bodies may comprise a mixture of iron or copper as the major component, and phosphorous and nickel (the latter for corrosion resistance) as minor components. In still another embodiment wherein the metal substrate is aluminum, the metal bodies may comprise aluminum as the major components and silicon (a brazing alloy ingredient) as a minor component.

This invention also contemplates a heat exchanger having a multiplicity of longitudinally aligned metal tubes transversely spaced from each other and joined at opposite ends by fluid inlet and fluid discharge manifolds, and shell means surrounding said tube having means for fluid introduction and fluid withdrawal, with each tube having an inner surface substrate and an outer surface substrate. The improvement comprises a single layer of randomly distributed metal bodies each individually bonded to the outer surface substrate, spaced from each other and substantially surrounded by the outer surface substrate so as to form body void space. The arithmetic average height e of the bodies on the outer surface substrate is between 0.005 inch and 0.06 inch and the body void space is between 10 percent and 90 percent of the outer surface substrate total area. A multiple layer of stacked metal particles is integrally bonded together and to the inner surface substrate to form interconnected pores of capillary size having an equivalent pore radius less than about 4.5 mils.

This invention also contemplates a method for enhancing heat transfer between a first fluid at first inlet temperature and a second fluid at second initial temperature substantially colder than the first inlet temperature in a heat exchanger wherein the first fluid is flowed in contact with a first side of a metal substrate and at least partially condensed by the second colder fluid contacting the opposite side to said first side of said metal substrate. A single layer of randomly distributed metal bodies is provided with each body individually bonded to the substrate first side, being spaced from each other and substantially surrounded by said substrate first side so as to form body void space. The arithmetic average height e of the bodies is between 0.005 inch and 0.06 inch, and the body void space is between 10 percent and 90 percent of the substrate first side total area. The first fluid is passed in contact with the metal body single layer so as to form condensate on the outer portion of the metal bodies and drain the so-formed condensate from the heat exchanger through the body void space. In one preferred embodiment of this method, the first fluid is contacted with and at least partially condensed by the metal body single layer with a heat transfer coefficient h such that $h/h_u$ is at least 3.0 where $h_u$ is the Nusselt heat transfer coefficient as described in "Heat Transmission" W. H. McAdams, pp. 259–261, McGraw-Hill Book Co., 1942. As previously indicated, the prior art condensation methods have been unable to obtain this level of improvement so that the present invention represents a substantial advance in the condensate heat transfer art.

DETAILED DESCRIPTION

FIG. 1 is a photomicrograph of a single layer of randomly distributed metal bodies, each bonded to a tubular substrate. This single layer surface was prepared by first screening copper powder to obtain a graded cut, i.e., through 20 and retained on 30 U.S. standard mesh screen, and the separated cut was coated with a 50 percent solution by weight of polyisobutylene in kerosene. The solution-coated copper grains were mixed with −325 mesh phos-copper brazing alloy of 92 percent copper–8 percent phosphorus by weight and in the ratio of 80 parts copper powder to 20 parts phos-copper. The kerosene was evaporated by forced air heating the coated powder. The resulting composite powder consisted of particles of phos-copper brazing alloy evenly disposed on and secured by the polyisobutylene coating to the surface of the copper particles. The powder was dry to the touch and free-flowing. A copper tube with 0.75 inch I.D. and 1.125 inch O.D. was coated with a 30 percent polyisobutylene in kerosene solution and the precoated particles were sprinkled on the tube outer surface. The tube was furnaced at 1600° F. for 15 minutes in an atmosphere of dissociated ammonia, cooled, and then tested for heat transfer characteristics as an enhanced heat transfer device.

This pre-coated method is not my invention but that of Robert C. Borchert and claimed in his copending patent application filed on even date with this application.

It should be noted that the randomly distributed metal bodies may comprise a multiplicity of particles bonded to each other or a single relatively large particle.

The aforedescribed heat transfer device may be characterized in terms of e wherein e is the arithmetic average height of the bodies on the metal substrate. It is also characterized by the body void space percentage of the substrate total area, i.e., the percentage of the substrate total area not covered by the base of the bodies. It has been experimentally determined that e is substantially equivalent to the arithmetic average of the smallest screen opening through which the particles pass and the largest screen opening on which such particles are retained. These relationships are set forth in Table A which shows that the value of e for the aforedescribed experimental enhanced heat transfer device is about 0.028 inch.

TABLE A

| U.S. Standard Screen Mesh | Opening (Inches) | e (inches) |
|---|---|---|
| 270 | 0.0021 | |
| 230 | 0.0024 | |
| 170 | 0.0035 | 0.03 (thru 170 on 230 mesh) |
| 120 | 0.0049 | |
| 100 | 0.0059 | 0.054 (thru 100 on 120 mesh) |

TABLE A-continued

| U.S. Standard Screen Mesh | Opening (Inches) | e (inches) |
|---|---|---|
| 80 | 0.007 | 0.0065 (thru 80 on 100 mesh) |
| 60 | 0.0098 | 0.0084 (thru 60 on 80 mesh) |
| 50 | 0.0117 | 0.0108 (thru 50 on 60 mesh) |
| 40 | 0.0165 | 0.0141 (thru 40 on 50 mesh) |
| 30 | 0.0232 | 0.0199 (thru 30 on 40 mesh) |
| 20 | 0.0331 | 0.028 (thru 20 on 30 mesh) |

In the determination of the body void space, a planar view of the enhanced heat transfer surface is magnified as for example illustrated in the FIG. 1 photomicrograph, and the number of metal bodies per unit of substrate area is determined by the visual count. It was experimentally observed that the metal bodies have a circular planar projection, and the planar projected area of a body was based on the diameter of the circular projection thereby providing a basis for calculating the area occupied by the metal bodies. The void space of the enhanced heat transfer device is the unoccupied area and herein is expressed as a percent of the substrate area. On this basis, the body void space of the aforedescribed experimental heat transfer device was about 30 percent of the substrate total area.

FIG. 2 shows three metal bodies a, b and c, all randomly disposed on the metal substrate, bonded thereto and substantially surrounded by the metal substrate. FIG. 3A shows an individual metal body having a minor dimension or lateral extent $L_1$ on the metal substrate, and FIG. 3B shows a metal body having a major dimension or lateral extent $L_2$. Both $L_1$ and $L_2$ are parallel to the metal substrate and normal to height e. FIG. 4 shows the condensation heat transfer and drainage mechanism of the present invention wherein the convexity of the metal bodies at their crests acts to increase the surface area of the liquid. Surface tension forces over the convex film $\Delta_o$ on such crests are resisted by the underlying metal thereby placing the liquid of such convex film $\Delta_o$ under pressure. In contrast, the fluid pressure in the vicinity of the flow channel $\Delta$ or trough is reduced by reason of the concave liquid surface. The fluid pressure differential causes the liquid to flow from the metal body crest or outer extremity to the flow channel, and in continuous operation, acts to thin the film $\Delta_o$ at the outer extremity thereby enhancing heat transfer at the convex surface. The condensate which collects in the flow channels $\Delta$ drains from the heat transfer device under the influence of gravity.

The aforedescribed heat transfer test device having an e of about 0.028 inch and a body void space of about 70 percent or an active heat transfer surface of $A_a$ of 0.30 is hereinafter referred to as Sample No. 1. A second enhanced heat transfer test device was prepared from the same previously described powders and pre-coating procedure, but the copper powder was through 30 mesh retained on 40 mesh. The resulting device (hereinafter referred to as Sample No. 2) had an e value of 0.02 inch and a body void space of 50 percent or an active condensation heat transfer surface $A_a$ of 0.50. Sample Numbers 1 and 2 were tested in a system where both steam and Refrigerant-114 were condensed in contact with the metal body single layer. Since these two fluids represent a wide range of surface tensions, the conclusions from these tests are applicable for substantially all fluids. The tubes were vertically oriented, heat input to the boiler was varied, and the tube wall temperature and condensing temperature difference measured at steady state conditions.

A mathematical model was developed for the metal body single layer surface as illustrated in FIG. 4 wherein the drainage is described as Nusselt-type flow condition modified to accommodate the random scatter of the bodies. The potentially active heat transfer area $A_a$ is a direct function of that fraction of the substrate total area $A_t$ on which the metal bodies reside and one is therefore, urged to maximize the $A_a$. However, area occupied by metal bodies is not available for condensate removal. Any elevation of the vertically oriented substrate surface the remaining body void space area must be maintained sufficient to conduct by gravity all of the condensate which as accumulated as a consequence of condensation occurring on the active area $A_a$ at higher elevations. The less body void area provided, the deeper will be the flowing layer of the accumulated condensate. As the layer deepens, more and more of the active area $A_a$ will become submerged in the condensate and become ineffective. Thus, it can be seen that the active fraction $A_a$ of the substrate surface $A_t$ cannot be increased without limit or the metal body occuping such active fraction will in effect dam the liquid flow and promote their own submergence. In the broad practice of this invention, the metal body void space should be at least 10 percent and preferably at least 40 percent. Stated otherwise, the metal bodies should not comprise more than 90 percent of the substrate total area and preferably not more than 60 percent thereof.

Limitations on the fraction of the substrate total area $A_t$ which can be effectively covered or occupied by the metal bodies are further influenced by the size of the metal bodies. Most practical forms of metal bodies approximate or approach spherical or hemispherical shapes wherein an increase in height e entails an associated increase in the substrate surface area covered by metal body. Thus, as metal body size becomes smaller, its height e and hence its protrusions above the flowing layer of condensate becomes less. Conversely, as metal body size increases its protrusion above the condensate layer also increases.

The fact that metal body shapes usually approach or approximate spherical or hemispherical forms has a further influence on performance. The larger the metal body, the larger the radius of curvature of the active area $A_a$ and the smaller and less effective are the forces which produce a film-thinning or film-stripping effect over the active area. Conversely, the smaller the metal body, the stronger are such film-thinning effects.

The foregoing factors interact to limit the active area in the following manner: In order to achieve very high fractions of active area approaching 90 percent, the size of the bodies e should be correspondingly increased toward 0.06 inch. This is necessary in order to obtain sufficient protrusions of the bodies above the condensate layer so that the active area is not submerged. However, the large radius of curvature of such large bodies make the active area less effective for thinning the condensate film. Therefore, an incremental increase in the active area in this regime is accompanied by an incremental decrease in effectiveness of all the active area, and by a net loss in heat transfer enhancement.

There are additional reasons why active area $A_a$ and body height e should not exceed 90 percent and 0.06 inch respectively. Large bodies tend to be more difficult to bond securely to the substrate that small bodies. Large bodies and the associated high active area represent a substantial requirement for metal particles to produce the enhanced surface, and manufacturing costs increase greatly. High fractions of active area are extremely difficult to achieve without locally stacking the bodies one upon the other and bridging across the void area. Finally, large bodies increase the overall diameter of tubular heat transfer elements, thereby greatly complicating the assembly of such elements into tube sheets, and also significantly increasing the overall size of heat exchangers.

If very small metal bodies are employed, their radius of curvature will be small and their film-thinning effect very strong. However, their protrusion above the substrate surface is low, therefore, requiring a large void area so that the flowing condensate layer will be shallow. Thus, it is seen that small metal bodies are necessarily associated with low active area. Similarly, low active area is necessarily associated with small bodies, because low active area must be off-set by the high film-thinning effectiveness of small metal bodies.

The foregoing factors plus others to be described tend to limit practice of the invention to void spaces not exceeding 90 percent or active areas $A_a$ not less than 10 percent and to corresponding body size or values of e not less than 0.005 inch. At lower fractions of active area and with associated lower values of e, submergence effects tend to overwhelm any improvement in film-thinning effects, and overall performance drops steeply. It is believed that rippling or turbulence in the flowing condensate layer repetitively immerses the small bodies and severely reduces their effectiveness.

The steep loss of performance mentioned above, attendant the use of very low active areas, makes quality control of enhanced condensing devices quite difficult. The performance penalty for a slight deficiency in active area can be very severe.

Another reason for limiting body void space to 90 percent (or active area $A_a$ to at least 10 percent) and body size (or e) to at least 0.005 inch is that tiny particles are quite prone to agglomerate and form clusters during the course of applying the single layer or bodies to the substrate surface. The formation of such clusters leaves relatively large void spaces, wherein the laminar boundary layer can re-form and attach to the substrate surface, thereby nullifying the enhancement effect.

Finally, small metal bodies are more sensitive to erosion and corrosion. The service life of heat exchangers employing devices enhanced with metal bodies less than 0.005 inch in height can thus be prohibitively short.

Table B summarizes data from the previously described Refrigerant 114 and steam boiling tests at different heat fluxes for Sample Numbers 1 and 2 and compares same with the predicted performance based on the aforedescribed mathematical model. The data supports the validity of the mathematical model. The root mean square deviation of the experimental data from the predicted coefficients is less than 25 percent and disregarding the data for steam at Q/A of 30,000 and 20,000 the root mean square deviation is less than 15 percent.

TABLE B

| Q/A BTU/hr, ft$^2$ | Vapor Composition | Sample No. | Measured ΔT °F. | Predicted ΔT °F. | Nusselt ΔT °F. |
|---|---|---|---|---|---|
| 6,000 | R-114 Refrigerant | 2 | 11.0 | 9.7 | 54.0 |
| 5,000 | R-114 Refrigerant | 2 | 8.4 | 7.4 | 42.0 |
| 4,000 | R-114 | 2 | 6.2 | 5.3 | 26.0 |

TABLE B-continued

| Q/A BTU/hr, ft$^2$ | Vapor Composition | Sample No. | Measured ΔT °F. | Predicted ΔT °F. | Nusselt ΔT °F. |
|---|---|---|---|---|---|
| 3,000 | Refrigerant R-114 | 2 | 4.1 | | 21.0 |
| 6,000 | Refrigerant R-114 | 1 | 12.0 | 13.0 | 54.0 |
| 5,000 | Refrigerant R-114 | 1 | 10.5 | 10.1 | 42.0 |
| 4,000 | Refrigerant R-114 | 1 | 9.0 | 7.4 | 26.0 |
| 30,000 | Refrigerant Steam | 1 | 4.6 | 2.6 | 21.0 |
| 20,000 | " | 1 | 2.9 | 1.5 | 12.2 |
| 15,000 | " | 1 | 1.0 | 1.0 | 8.3 |

The mathematical model was used to study a metal body single layer surface in which e, $L_1$, and $L_2$ are equal to each other and the metal body outer extremity has a hemispherical geometry. In this study, the condensation heat transfer coefficient ratio $h/h_u$ was determined for e values of 0.01, 0.02, 0.03 and 0.04 inches as a function of the active heat transfer fraction $A_a$ of a metal body single layered surface. These relationships were established for Refrigerant 114 on a 20 ft. long vertical tube (FIG. 6), ethylene on a 10 ft. long vertical tube (FIG. 7) and steam on a 20 ft. long vertical tube (FIG. 8). In each instance, the tube diameter is not a consideration since coefficients are based on total surface area.

Figure 6:
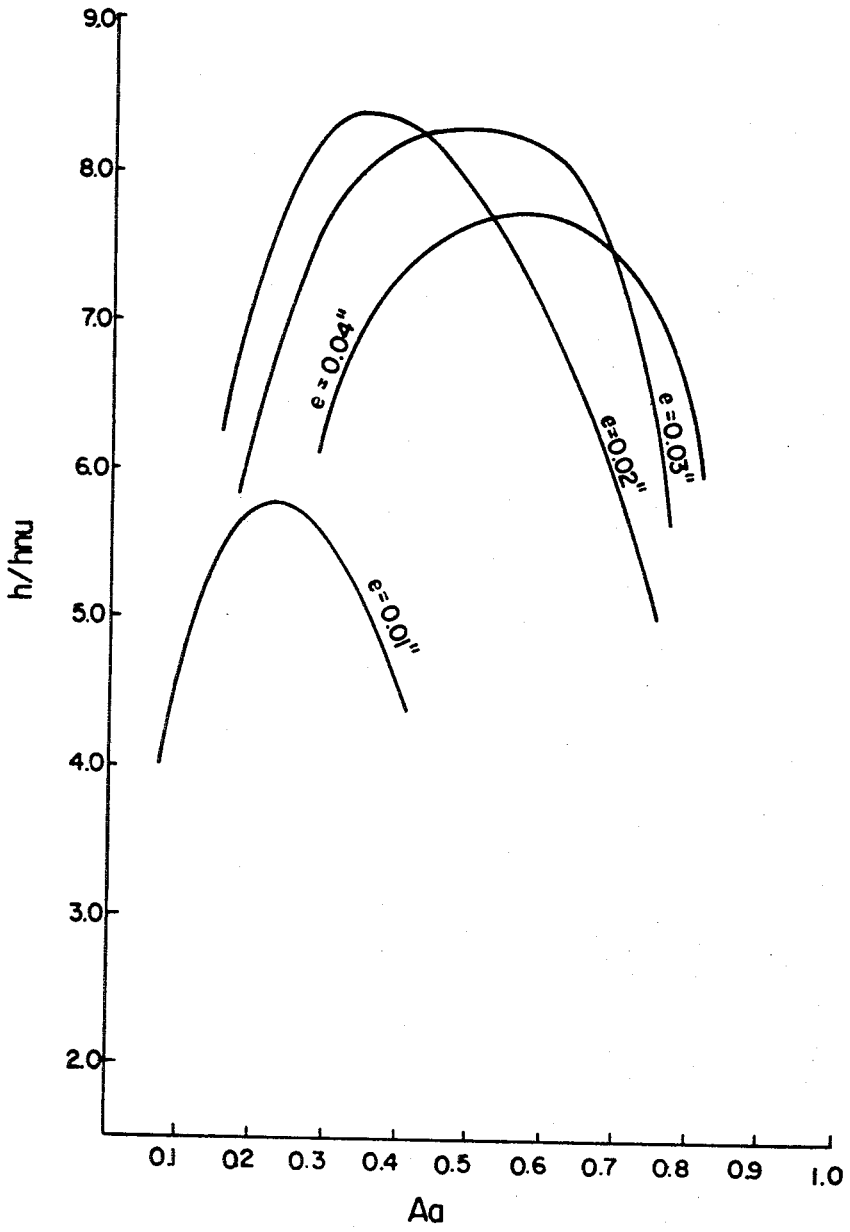
FIG. 6 is a graph of condensation heat transfer coefficient ratio h/hu vs. active heat transfer surface fraction Aa for Refrigerant 114 on a 20 ft. long vertical tube.
Figure 7:
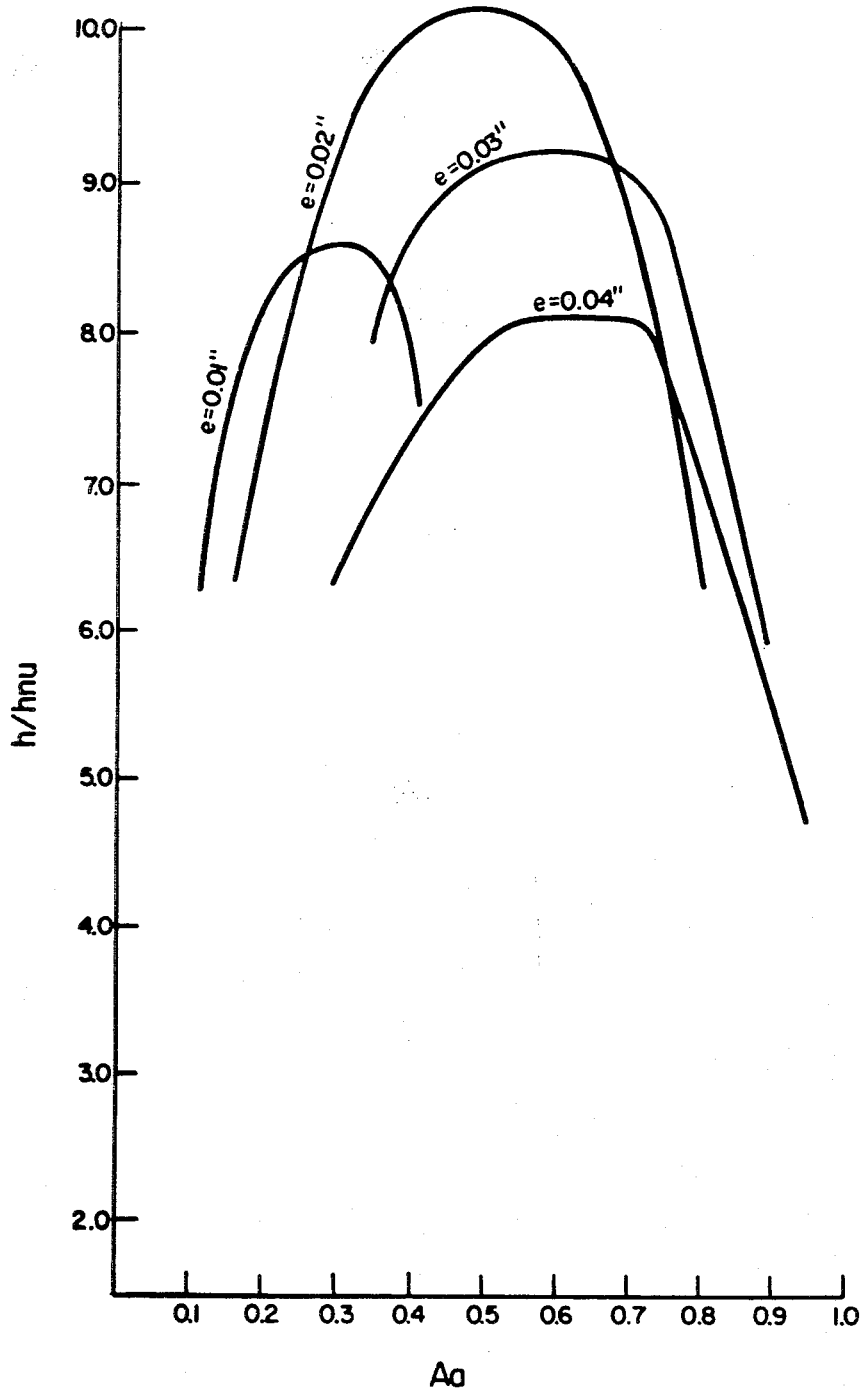
FIG. 7 is a graph of condensation heat transfer coefficient ratio h/hu vs. active heat transfer surface fraction Aa for ethylene on a 10 ft. long vertical tube.
Figure 8:
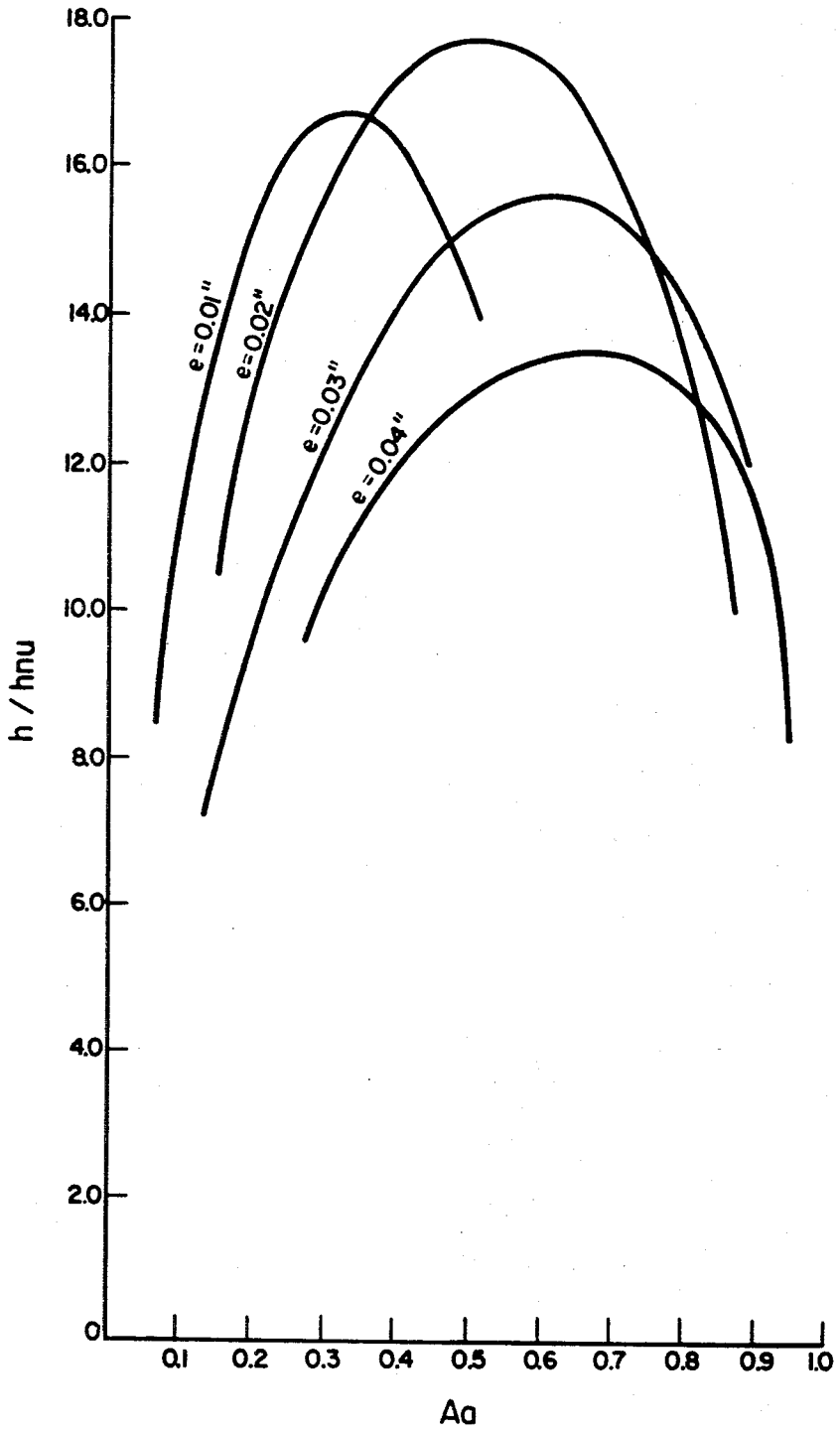
FIG. 8 is a graph of condensation heat transfer coefficient ratio h/hu vs. active heat transfer surface fraction Aa for steam on a 20 ft. long vertical tube.

FIGS. 6–8 show that for a given value of metal body height e, the condensation heat transfer coefficient h is maximum at an optimum value active heat transfer surface area $A_a$. Surfaces with $A_a$ values less than the optimum value tend to be deficient in the number of metal bodies per unit total substrate area. Surfaces with active heat transfer $A_a$ values greater than that required for optimum performance tend to have an excess of metal bodies causing impaired drainage characteristics. The subsequent increase in condensate depth causes partial or whole inundation of the metal body crest by liquid, therefore, insulating a significant portion of the potential active heat transfer area $A_a$.

FIGS. 6–8 also illustrate the basis for the broad and narrow ranges of this invention for available body height e and body void space. By way of example in referring to FIG. 6, if a height e of 0.02 inch is selected, the condensation heat transfer coefficient ratio $h/h_u$ will be relatively low if $A_a$ is less than 0.1 or more than 0.9. Also, the highest condensation heat transfer ratio will be obtained if an $A_a$ value is selected within the preferred range of between 0.2 and 0.6, i.e., a body void space between 40 percent and 80 percent of the substrate total area. Also, by way of illustration using FIG. 7, the highest condensation heat transfer ratios are achieved with body heights within the range 0.01 inch and 0.4 inch. Stated otherwise, e values below 0.01 inch and above 0.04 inch would appear to provide lower condensation heat transfer ratios than metal body single layered surfaces within this preferred range.

Figure 9:
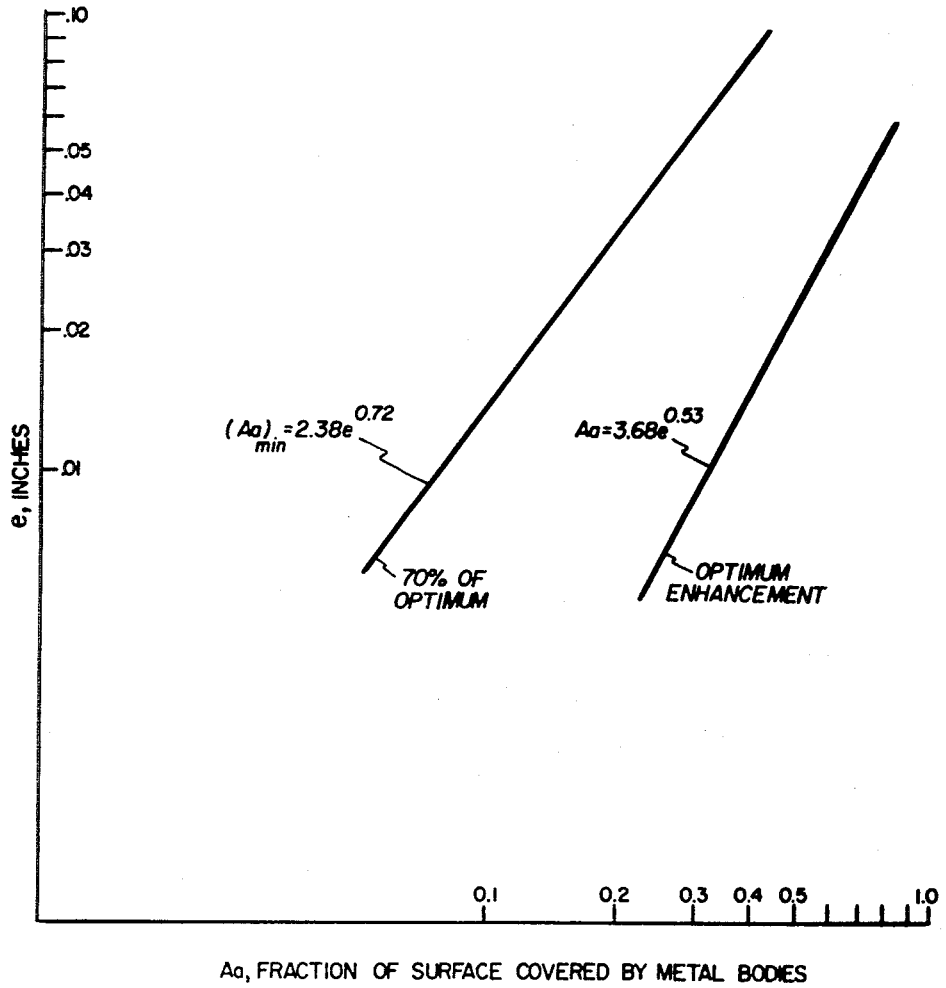
FIG. 9 is a graph of arithmetic average height e of the bodies on the substrate vs. active heat transfer surface fraction Aa for all condensing fluids showing optimum and 70% of optimum heat transfer enhancement.

FIG. 9 was derived from FIGS. 6–8 data and additional data which was developed with the application of the mathematical model to heat transfer tubes whose length varied from 5 to 20 feet. The FIG. 9 was constructed by selecting the body height e and $A_a$ points where highest condensation heat transfer enhancement is obtained, plotting same, and interconnecting the points as a straight line identified as "optimum enhancement". The formula for this line is derived as $A_a=3.68$ e 0.53. Thus, the practioneer may first select the desired body height e and then use the line to identify the $A_a$ value which will provide maximum condensation heat transfer enhancement for the selected body height e. The second line on the FIG. 9 graph labeled "70 percent of optimum" was obtained by first locating a point on the low $A_a$ side of each metal body height e curve in FIGS. 6–8 which is 70 percent of the maximum condensation heat transfer enhancement $h/h_u$. These points were plotted and interconnected to form the second line. The formula for same was derived as $A_a=2.38$ e 0.72. This line is useful to the practioneer in evaluating the performance effect of using substantially fewer metal bodies of a given height e to form a less expensive metal body single layer enhanced heat transfer device.

It is important to understand that the single layered metal body surface of this invention is quite different from a multi-layered porous boiling surface, i.e. as taught by Milton U.S. Pat. No. 3,384,154 in which metal particles are stacked an integrally bonded together and to a metal substrate to form interconnected pores of capillary size. Porous boiling surfaces would not be suitable for condensation heat transfer in the manner of this invention because their interconnecting porous structure would inhibit effective drainage by liquid condensate from the heat exchanger.

On the other hand porous boiling multi-layered surfaces can be advantageously employed in combination with the single layered metal body surface where the second fluid is to be boiled in heat exchange relation with the condensing first fluid.

In processes involving condensation on smooth tubes the individual condensation heat transfer coefficient is typically in the order of 500 BTU/hr, ft$^2$, °F. Accordingly, the overall coefficient realized in heat exchangers which are equipped with smooth tubes is about 330 BTU/hr, ft$^2$, °F. and exchangers equipped with an enhanced condensing surface of this invention which provides an improvement of 400 percent in the condensing side coefficient will provide a 200 percent improvement of the overall heat transfer coefficient. However, boiling coefficients of 12,000 BTU/hr, ft$^2$, °F. are achievable using the porous multi-layer and, therefore, an improvement of the condensing heat transfer coefficient from the smooth tube value of 500 BTU/hr, ft$^2$, °F. will have a nearly proportional effect on the overall heat transfer coefficient, thereby providing a means of fabricating equipment with an overall coefficient of several thousand BTU/hr, ft$^2$, °F.

FIG. 5 is a schematic flow diagram which exemplifies a commercial application of our invention in a cryogenic air separation double column-main condenser for condensation heat transfer. Cold air feed is introduced through conduit 10 to the base of higher pressure lower column 11 where it rises against descending oxygen-enriched liquid in mass transfer relationship using spaced distillation trays 12. The nitrogen vapor reaching the upper end of lower column 11 enters main condenser 13 and is condensed by heat transfer against boiling liquid oxygen in the base of lower pressure upper column 14 to provide reflux liquid for the lower column. The enhanced heat transfer device of this invention is provided on the higher pressure nitrogen side of main condenser 13 if desired a porous multi particle layer according to the teachings of Milton, U.S. Pat. No. 3,384,154 may be provided on the oxygen side of the main condenser.

In the practice of this invention the materials of construction are dictated by economic considerations and functional requirements relating to, i.e. corrosion and/or errosion resistance.

The metal body surface of the test sample described above involved copper as the major component and phosphorous as the minor component. Other commercially significant combinations involve iron as the major and nickel as the minor component and aluminum as the major and silicon as the minor component.

The enhanced condensation heat transfer device of this invention has been specifically described as applied to the outer surface of tubes, but may advantageously be employed with metal substrates of any shape including flat plates and irregular forms.

Although particular embodiments of the invention have been described in detail it will be understood by those skilled in the heat transfer art that certain features may be practiced without others and that modifications are contemplated, all within the scope of the claims.

What is claimed is:

1. A method for enhanced heat transfer between a first fluid at first inlet temperature and a second fluid at second initial temperature substantially colder than said first inlet temperature in a heat exchanger wherein said first fluid is flowed in contact with a first side of a metal substrate and at least partially condensed by the second colder fluid contacting the opposite side to said first side of said metal substrate, comprising the steps of: providing a single layer of randomly distributed metal bodies each individually bonded to the substrate first side spaced from each other and substantially surrounded by said substrate first side so as to form body void space with the arithmetic average height e of the bodies between 0.005 inch and 0.06 inch and the body void space between 10 percent and 90 percent of the substrate first side total area; and passing said first fluid in contact with the metal body single layer so as to form condensate on the outer portion of said metal bodies and drain the so-formed condensate from said heat exchanger through said body void space.

2. A method for enhanced heat transfer according to claim 1 wherein said first fluid is contacted with and at least partially condensed by the metal body single layer with a heat transfer coefficient ratio to a smooth surface h/hu of at least 3.

3. A method for enhanced heat transfer according to claim 1 wherein a multiple layer of stacked metal particles is integrally bonded together and to said opposite side of said metal substrate to form interconnected pores having an equivalent pore radius less than 4.5 mils and said second colder fluid is boiled in contact with said multiple layer.

* * * * *